US006716045B2

(12) United States Patent
Meredith

(10) Patent No.: US 6,716,045 B2
(45) Date of Patent: Apr. 6, 2004

(54) CONNECTOR WITH INCREASED CREEPAGE

(75) Inventor: Kevin R. Meredith, Louisville, KY (US)

(73) Assignee: Robinson Nugent, Inc., New Albany, IN (US)

( * ) Notice: Subject to any disclaimer, the term of this patent is extended or adjusted under 35 U.S.C. 154(b) by 48 days.

(21) Appl. No.: 10/013,439

(22) Filed: Dec. 10, 2001

(65) Prior Publication Data

US 2003/0109177 A1 Jun. 12, 2003

(51) Int. Cl.[7] ..... H01R 13/53
(52) U.S. Cl. ..... 439/181; 439/608
(58) Field of Search ..... 439/608, 181–182, 439/186, 187, 701, 79, 108, 680, 681, 678, 679, 378–381

(56) References Cited

U.S. PATENT DOCUMENTS 4,449,767 A * 5/1984 Weidler ..... 439/64
4,834,678 A * 5/1989 Emadi et al. ..... 439/701
5,055,055 A 10/1991 Bakker ..... 439/78
5,139,426 A 8/1992 Barkus et al. ..... 439/65
5,158,471 A 10/1992 Fedder et al. ..... 439/80
5,217,381 A * 6/1993 Zell et al. ..... 439/79
5,286,212 A 2/1994 Broeksteeg ..... 439/108
5,356,300 A * 10/1994 Costello et al. ..... 439/101
5,443,398 A 8/1995 Ortega ..... 439/378
5,535,100 A 7/1996 Lubahn et al. ..... 361/801
5,542,851 A 8/1996 Chikano ..... 439/108
5,667,392 A 9/1997 Kocher et al. ..... 439/79

OTHER PUBLICATIONS

IEC Standard 61076–4–101 2001.
International Standard—Information technology equipment—Safety—IEC 60950–1.

* cited by examiner

*Primary Examiner*—Ross Gushi
(74) *Attorney, Agent, or Firm*—Barnes & Thornburg

(57) ABSTRACT

An electrical connector includes a first contact, a second contact spaced apart from the first contact by a given distance, and insulative material extending between the first and second contacts. The insulative material extending between the first and second contacts is configured to include a creepage maze. According to another aspect of the invention, the given distance is smaller than the minimum creepage distance specified for the material group of the insulative material and for the degree of pollution of the insulative material.

49 Claims, 10 Drawing Sheets

CONNECTOR WITH INCREASED CREEPAGE

BACKGROUND AND SUMMARY OF INVENTION

This invention relates to electrical connectors and more particularly to electrical connectors having closely spaced contacts.

Adjacent contacts within connectors are typically separated from one another by air and by insulative material. The shortest distance between adjacent contacts measured through the air is known as the "clearance." A minimum clearance distance between adjacent contacts is required to prevent peak voltages between the contacts from breaking down the clearance by arcing through air.

The shortest distance between adjacent contacts measured along the surface of the barrier features of the insulative material is known as the "creepage." A minimum creepage distance between adjacent contacts is required to prevent peak voltages between the contacts from electrically breaking down the surface film on the insulative material. It is known that breakdown or flashover of insulation will occur between adjacent contacts if the distance between the contacts along the surface of the insulation is not sufficient to prevent such breakdown. For known working voltages and pollution degrees, tables are typically provided in connector specifications setting out the required minimum creepage distance based on the material group of the insulative material used in the connector and the degree of pollution of the insulative material. Typically these tables differentiate between pollution degrees (ranging from pollution degree 1 to pollution degree 3) and the material group from which the insulative material is selected for the connector (material group I, material group II, material group IIIa or material group IIIb). As the pollution degree increases, the minimum creepage distance increases. Similarly, as the material group number increases, the minimum creepage distance increases.

Typically, in known connectors, contacts are embedded or molded within an insulative housing which separates adjacent contacts. The insulative housing typically includes a planar face from which male contacts extend perpendicular to the planar face or the insulative housing is formed to include cavities in which female contacts are received perpendicular to the planar face. For connectors having planar surfaces separating the contacts, the creepage is often the same physical distance as the clearance between the contacts.

Occasionally, contaminant levels on the insulative surfaces dictate creepage distances that are higher than the clearance value. Therefore, contacts are sometimes separated by the specified minimum creepage which places the contacts farther apart from each other than the specified minimum clearance. Under many circumstances, it is desirable to place contacts as close to each other as allowed by the clearance specifications for the connector within which the contacts are incorporated.

According to the present invention, insulative material separating adjacent contacts is formed so that the creepage between the contacts is greater than the clearance between the contacts. An electrical connector includes a first contact, a second contact spaced apart from the given contact by a given distance, and insulative material extending between the first and second contacts. The insulative material extending between the first and second contacts is configured so that creepage between the first and second contacts is greater than the given distance. According to a further aspect of the invention, the insulative material extending between the first and second contacts is configured to form a raised portion between the first and second contacts. According to a yet another aspect of the invention, the given distance is smaller than the minimum creepage specified for the material group of the insulative material and for the degree of pollution of the insulative material.

According to still another aspect of this invention, an IEC 61076-4-101 style A or D connector is modified to include a power connector portion in the region of the connector normally reserved for code keying feature. According to a further aspect of this invention, an IEC 61076-4-101 connector (any style, A through F) is modified to include a power connector portion in the region of the connector normally reserved for multi-purpose center. As referred to in this specification and claims, IEC 61076-4-101 shall mean IEC 61076-4-101:2001.

Additional features of the present invention will become apparent to those skilled in the art upon a consideration of the following detailed description of the following embodiments exemplifying the best mode of carrying out the invention as presently perceived.

BRIEF DESCRIPTION OF DRAWINGS

The detailed description particularly refers to the accompanying drawings in which.

DETAILED DESCRIPTION OF DRAWINGS

A standard IEC 61076-4-101 style A or D connector includes a central portion which is reserved for code keying feature. (IEC is an acronym of the International Electrotechnical Commission.) The code keying feature (sometimes referred to as key coding or code device feature) has been unpopular in the industry, and is, therefore, typically not used. Thus, the real estate of a standard IEC 61076-4-101 style A or D connector designated for code keying feature is often wasted. According to one aspect of this invention, an IEC 61076-4-101 style A or D connector is modified to include a power connector portion in the region of the connector normally reserved for code keying feature. According to another aspect of this invention, an IEC 61076-4-101 connector (any style, A through F) is modified to include a power connector portion in the region of the connector normally reserved for multi-purpose center (sometimes referred to as MPC). As previously mentioned, IEC 61076-4-101 shall mean IEC 61076-4-101:2001.

Figure 1:
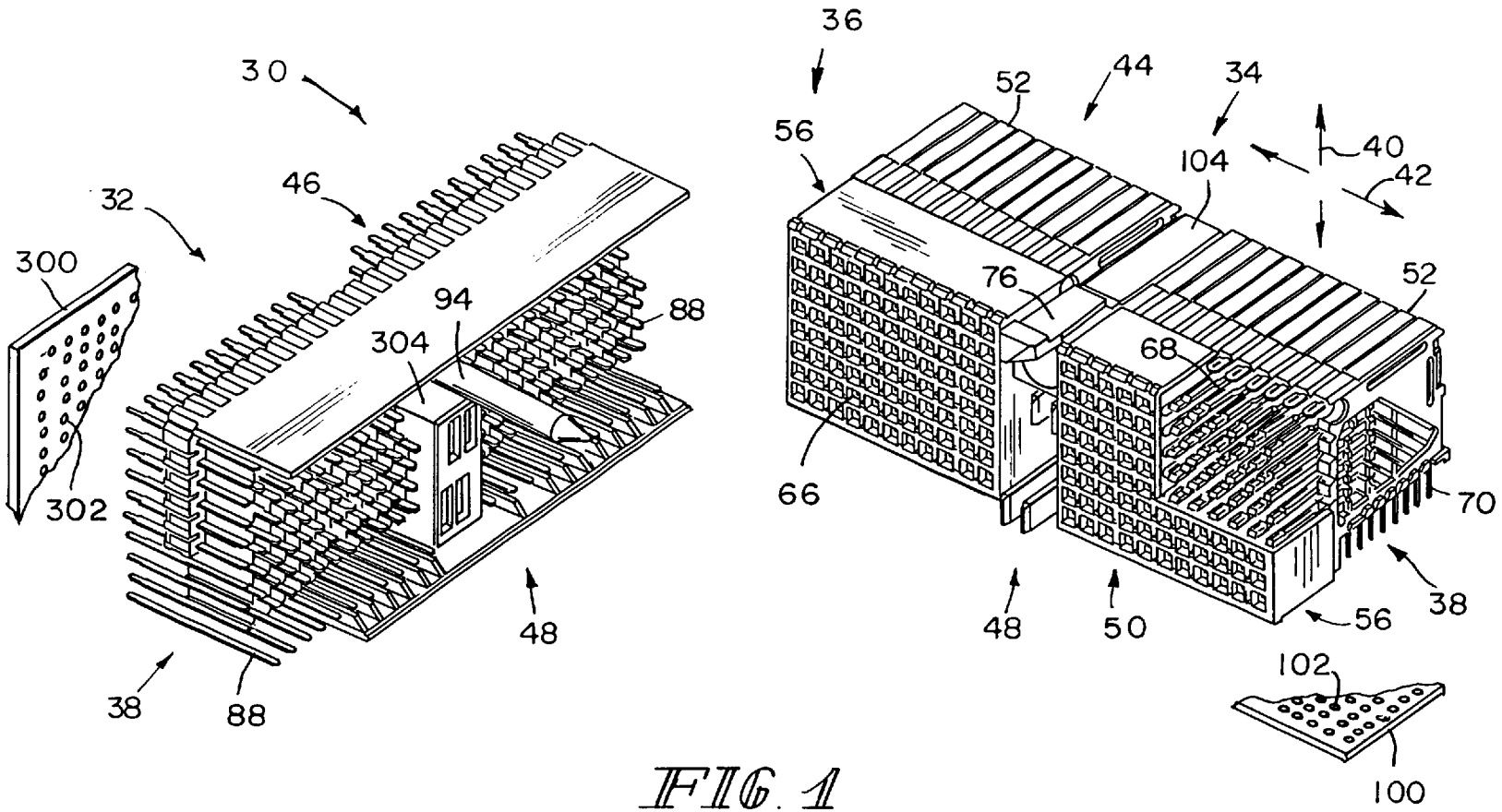
FIG. 1 is a perspective partially exploded view of a two-part right-angle connector in accordance with the present invention, showing a socket connector configured to be coupled to a daughtercard and a header connector configured to be coupled to a motherboard.

FIG. 1 shows a two-part D-style connector 30 defined by the IEC 61076-4-101 specification. The IEC 61076-4-101 specification or standard sets out parameters for a two-part fight-angle connector for coupling a daughtercard to a motherboard or backplane having a basic grid of 2 millimeters in accordance with the IEC 917 specification. A connector of this type is described in a U.S. Pat. No. 6,146,202, entitled "Connector Apparatus", the entire content of which is incorporated herein by reference. This type of connector is typically used in telecommunications industry for routing high frequency digital signals.

Figure 2:
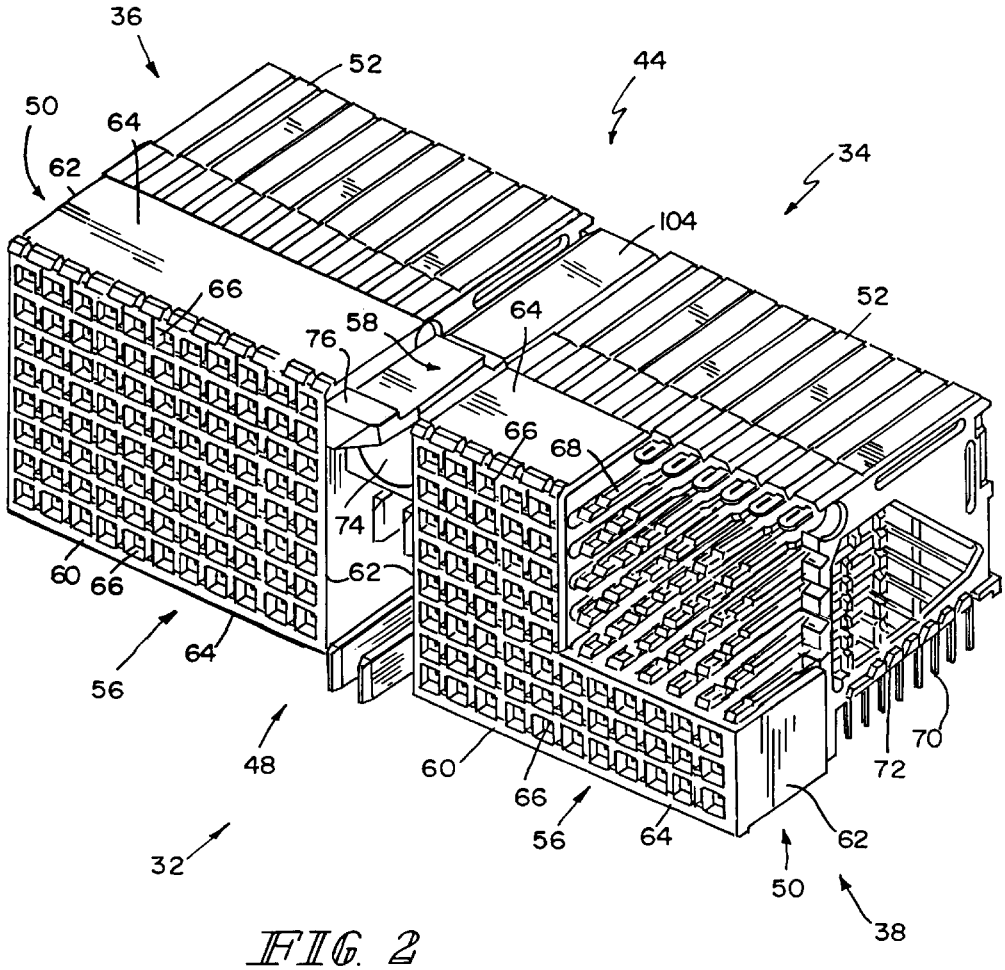
FIG. 2 is a perspective view of the FIG. 1 socket connector, showing a front cap, a guide finger, four power blades, a plurality of connector modules and a daughtercard component.
Figure 3:
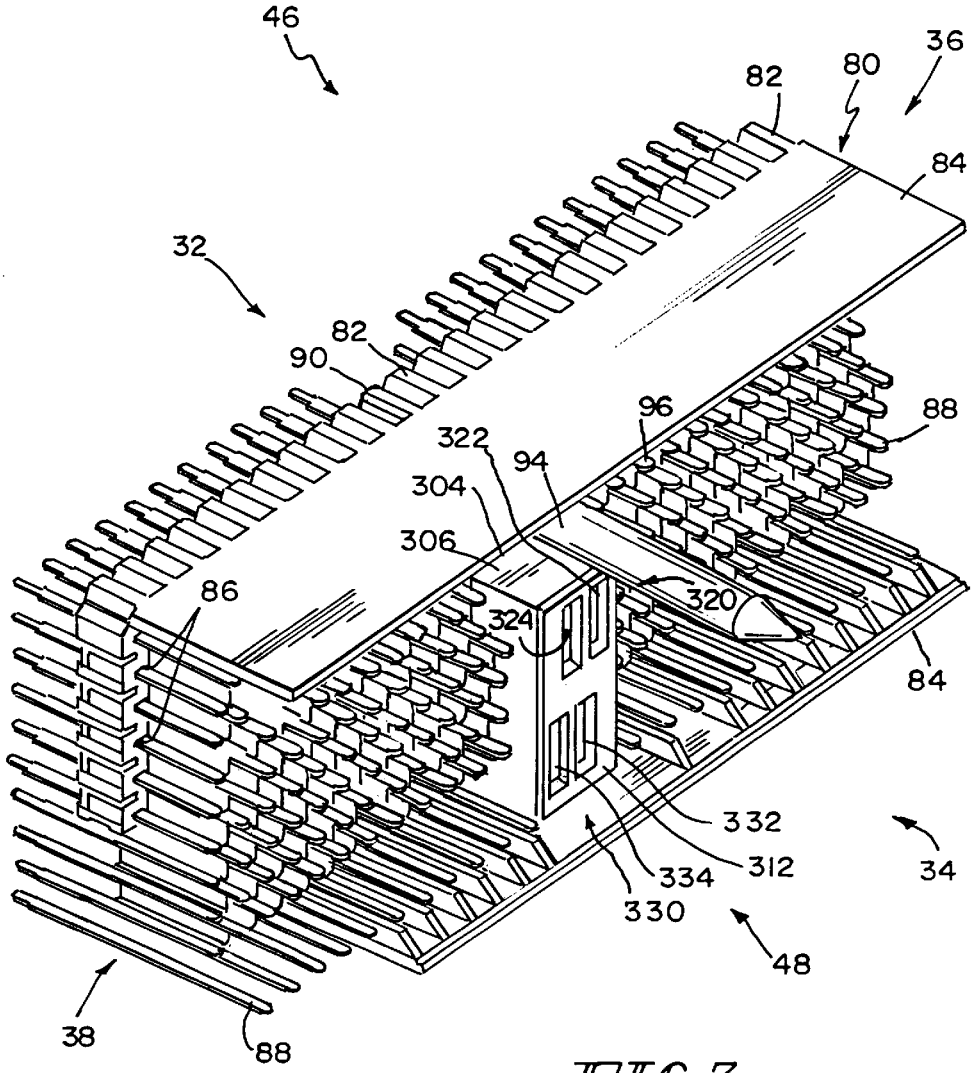
FIG. 3 is a perspective view of the FIG. 1 header connector, showing a header body, a guide pin, a plurality of signal pins and a motherboard component.

The connector 30 includes a front 32, a rear 34, a first side 36, a second side 38, a vertical axis 40 and a transverse axis 42. As used in this description, the phrase "forwardly" will be used to mean toward the front 32 of the connector 30, and the phrase "rearwardly" will be used to mean toward the rear 34 of the connector 30. As shown in FIGS. 1–3, the two-part connector 30 includes a socket connector 44 configured to be coupled to a daughtercard 100 and a header connector 46 configured to be coupled to a motherboard 300.

The connector 30 includes a power connector portion 48 in the region of the connector 30 normally reserved for code keying feature. The power connector portion 48 is configured to transfer power from a power source on the motherboard 300 to power consuming components on the daughtercard 100. The power connector portion 48 includes a daughtercard component 104 configured to be coupled to the daughtercard 100 and a motherboard component 304 configured to be coupled to the motherboard 300. The power connector portion 48 must meet the IEC-60950 creepage specification. The IEC-60950 specification defines the creep age as the shortest distance between two conductive parts measured along the surface of the insulation. For known working voltages and pollution degrees, tables are typically provided in connector specifications setting out the required minimum creepage based on the material group of the insulative material used in the connector and the degree of pollution of the insulative material. In the illustrated embodiment, the minimum creep age between adjacent contacts in the power connector portion 48 must be 1.2 millimeters. The power connector portion 48 is of the type described in a U.S. patent application Ser. No. 09/606,801, filed on Jun. 29, 2000, and entitled "Power and Guidance Connector", now U.S. Pat. No. 6,431,886, the entire content of which is incorporated herein by reference. As referred to in this specification and claims, IEC 60950 standard shall mean IBC 60950-1:2001 standard.

As shown in FIG. 2, the socket connector 44 includes a front cap 50 into which the daughtercard component 104 and a plurality of connector modules or wafers 52 are inserted. The front cap 50 is formed of electrically insulating material, and includes two box-shaped portions 56 which are joined together in the middle by a flange portion 58. Each box-shaped portion 56 includes a front wall 60, a pair of side walls 62, and top and bottom walls 64 extending rearwardly from the top and bottom edges of the front wall 60. The interior surfaces of the top and bottom walls 64 are configured to form a plurality of guide slots for guiding insertion of the connector modules 52. In the illustrated embodiment, each box shaped portion 56 includes eleven guide slots for receiving eleven connector modules 52. It will be understood however that the box shaped portions 56 may very well be designed to include any number of guide slots depending upon the application. The front wall 60 is formed to include a plurality pin-insertion windows 66. As shown, the plurality of pin-insertion windows 66 are arranged in a grid form as an array of horizontal rows and vertical columns. In the illustrated embodiment, each box-shaped portion 56 includes eight rows of eleven pin-insertion windows 66. It will be understood, however, that the socket connector 44 may very well be designed to include a different combination of rows and columns of pin-insertion windows 66.

Each connector module or wafer 52 includes eight signal paths, which are encased in a body of insulating material using a suitable process—such as overmolding or insert molding. Each signal path connects a forwardly-extending receptacle contact 68 to a downwardly-extending pin tail 70. Each receptacle contact 68 includes a pair of opposed cantilevered beams into which a signal pin 88 of the header connector 46 is inserted when the socket and header connectors 44, 46 are mated. The receptacle contacts 68 are configured to be aligned with the pin-insertion windows 66 when the connector modules 52 are inserted into the front cap 50. The socket connector 44 includes a downwardly-facing card-engaging face 72 which extends perpendicular to the front wall 60 of the socket connector 44. The pin tails 70 extend perpendicularly from the card-engaging face 72 for receipt in through holes 102 extending through the daughtercard 100. The pin tails 70 and the through holes 102 are arranged in two groups corresponding to the two box-shaped portions 56 each group comprising eight rows of eleven pin tails 70 or through holes 102 respectively. The pin tails 70 are sized to press fit in the through holes 102.

Figure 4:
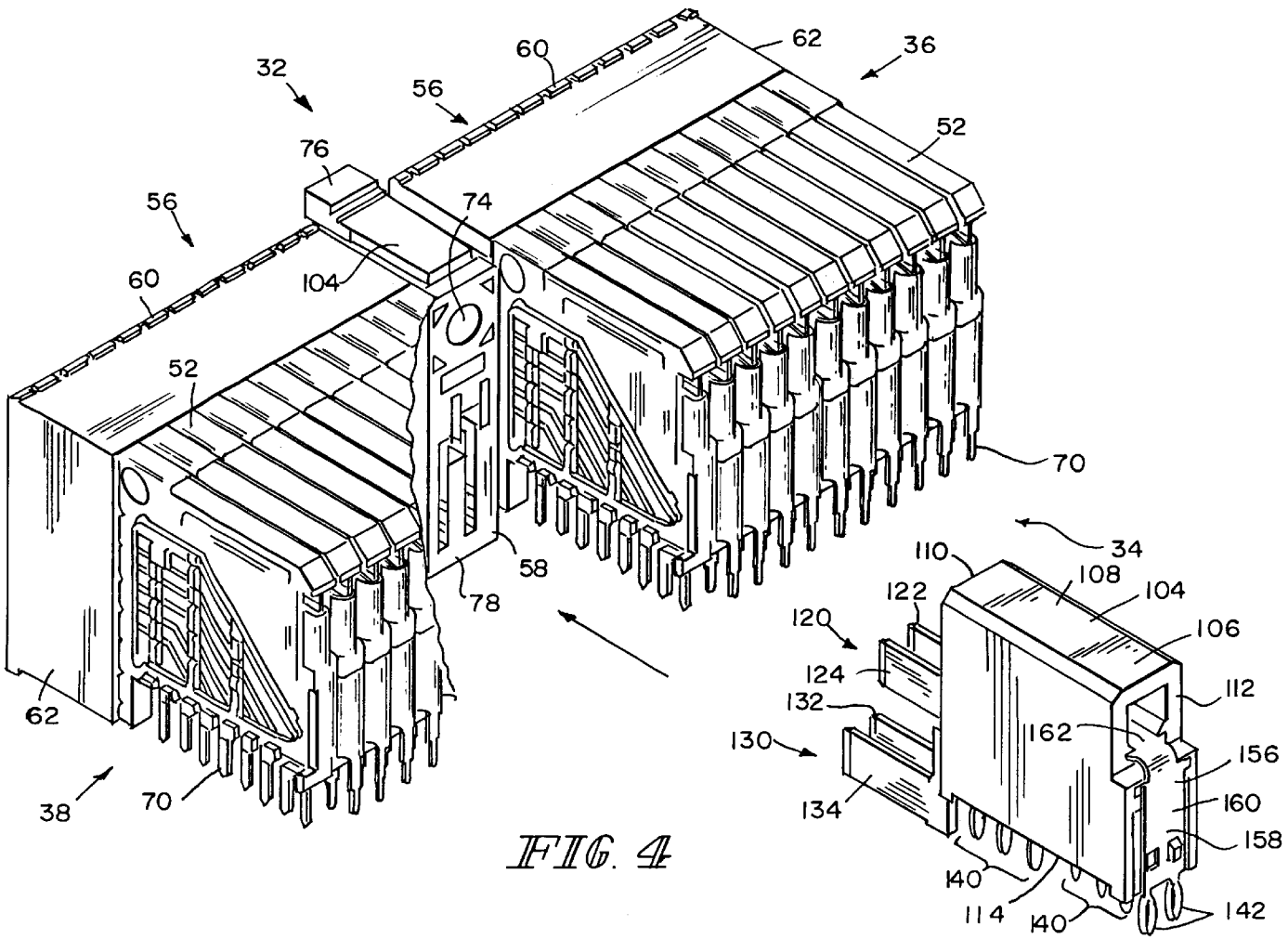
FIG. 4 is a perspective partially exploded view of the socket connector, showing the front cap, the connector modules, the pin tails and the daughtercard component.
Figure 7:
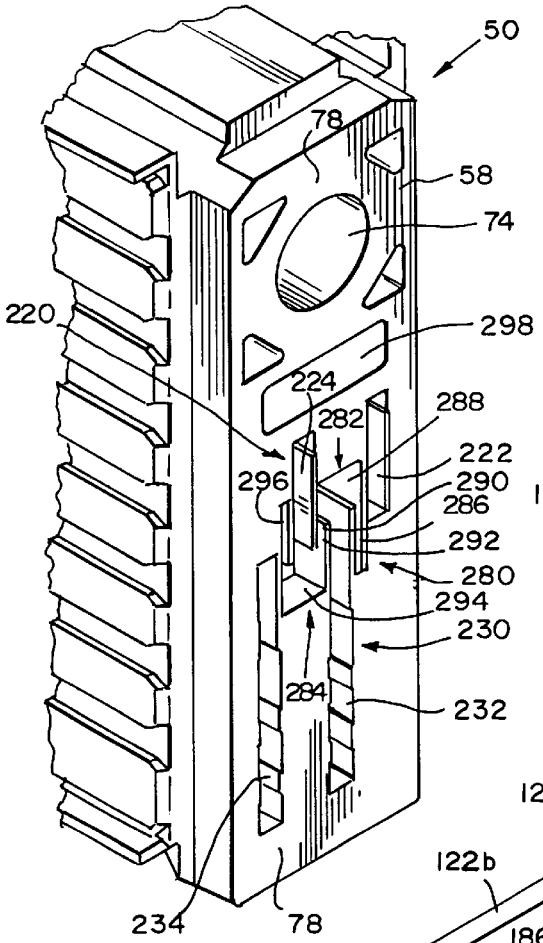
FIG. 7 is an enlarged partial perspective view of a flange portion of the front cap, showing four blade-receiving slots, a complementary creepage maze-receiving cavity, a guide pin-receiving opening and an alignment tab-receiving cavity.

The internal surface of the front wall 60 may be formed to include a plurality of rearwardly-extending preopening fingers configured for insertion between the opposed cantilevered beams of the receptacle contacts 68 to keep the cantilevered beams separated. This facilitates insertion of the signal pins 88 into the receptacle contacts 68 when the connectors 44, 46 are mated. The internal surface of the front wall 60 may be further formed to include rearwardly-extending vertical partitions to further facilitate separation of the receptacle contacts 68 from each other and alignment of the receptacle contacts 68 with the pin-insertion windows 66. The flange portion 58 of the front cap 50 includes a guide pin-receiving circular opening 74, and a box-shaped guide finger 76 extending forwardly therefrom. The flange portion 58 includes a forwardly-facing wall (obscured view) and a rearwardly-facing wall 78 as shown in FIGS. 4 and 7. The forwardly-facing wall is configured to engage the motherboard component 304 when the socket connector 44 is mated with the header connector 46. The rearwardly-facing wall 78 is configured to engage the daughtercard component 104 when the daughtercard component 104 is mated with the flange portion 58.

Referring to FIG. 3, the header connector 46 includes a header body 80 formed of electrically insulating material. The header body 80 includes a front wall 82 and top and bottom walls 84 extending rearwardly from the top and bottom edges of the front wall 82. The front wall 82 is formed to include a plurality signal pin-insertion windows 86 into which a plurality of signal pins 88 are inserted. The signal pins 88 extend perpendicularly from a forwardly-facing board-engaging face 90 of the front wall 82 for receipt in through holes 302 extending through the motherboard 300. The signal pins 88 extend perpendicularly from a rearwardly-facing socket-engaging face 92 of the front wall 82 for receipt in the receptacle contacts 68 in the socket connector 44 through the pin-insertion windows 66 when the socket and header connectors 44, 46 are mated. In the illustrated embodiment, the pin-insertion windows 66 in the socket connector 44, the receptacle contacts 68, the pin-insertion windows 86 in the header connector 46, the signal pins 88 and the through holes 302 in the motherboard 300 are all arranged in two groups—each group comprising eight rows of eleven. The signal pins 88 are sized to press fit in the pin-insertion windows 86 in the header connector 46 and the through holes 302 in the motherboard 300.

The header body 80 is formed to include the motheboard component 304. When the socket connector 44 and the header connector 46 are mated, the motheboard component 304 mates with the daughtercard component 104 to transfer power from the motherboard 300 to the daughtercard 100. The header body 80 further includes a guide pin 94 extending rearwardly from the rearwardly-facing socket-engaging face 92 of the front wall 82. In the illustrated embodiment, the guide pin 94 is electrically coupled to the ground circuitry on the motherboard 300, and serves to electrically couple the ground circuitry on the daughtercard 100 to the ground circuitry on the motherboard 300. However, it will be understood that the guide pin 94 may instead serve some other function. When the socket connector 44 is mated with the header connector 46, the guide pin 94 is received in the guide pin-receiving circular opening 74 in the flange portion 58 and the guide finger 76 is received in a guide finger-receiving rectangular slot 96 in the top wall 84 of the header connector 46 to ensure alignment of the signal pins 88 with the pin-insertion windows 66.

The guide pin 94 and the guide finger 76 each include a tapering front section to facilitate insertion of the guide pin 94 into the guide pin-receiving opening 74 and insertion of the guide finger 76 in the guide finger-receiving slot 96 when the connectors 44, 46 are mated. The socket connector 44 and the header connector 46 may be shielded to minimize cross-talk between adjacent signal lines to minimize degradation of high speed digital signals passing through the connector 30. Reference may be made to the above-mentioned U.S. Pat. No. 6,146,202 for an illustration of shielded header and socket connectors.

Figure 5:
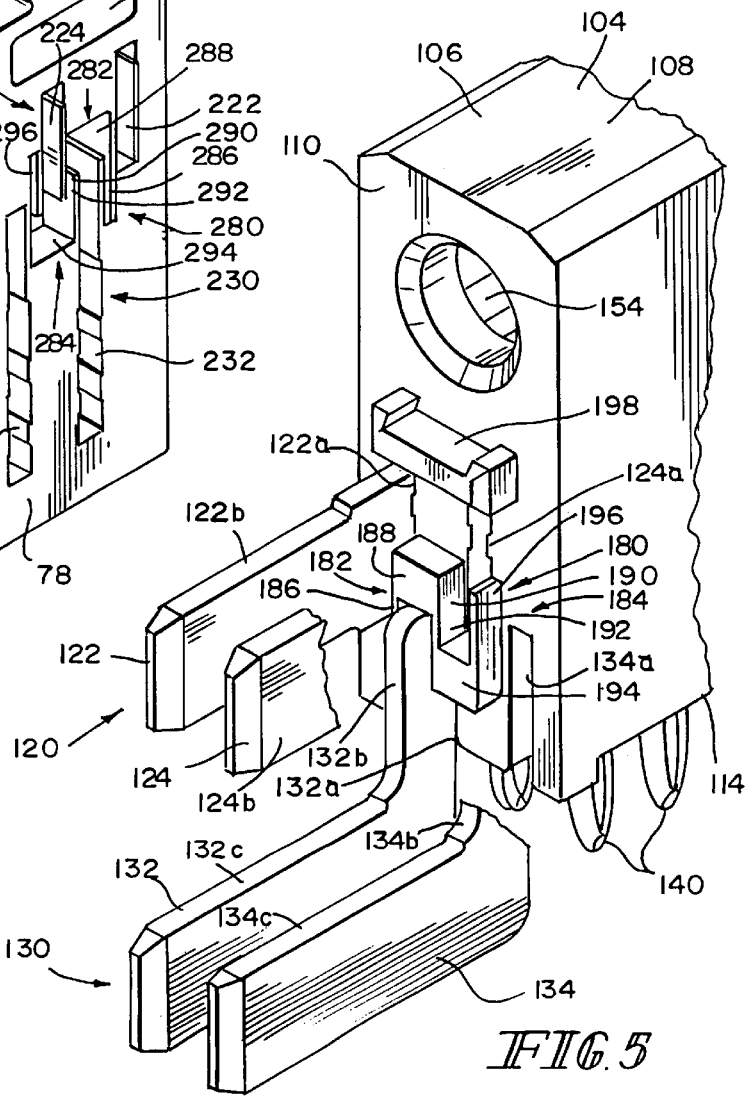
FIG. 5 is an enlarged partial perspective view of the daughtercard component, showing the four power blades, power connection pins, creepage maze, an alignment tab and a guide pin-receiving opening.
Figure 6:
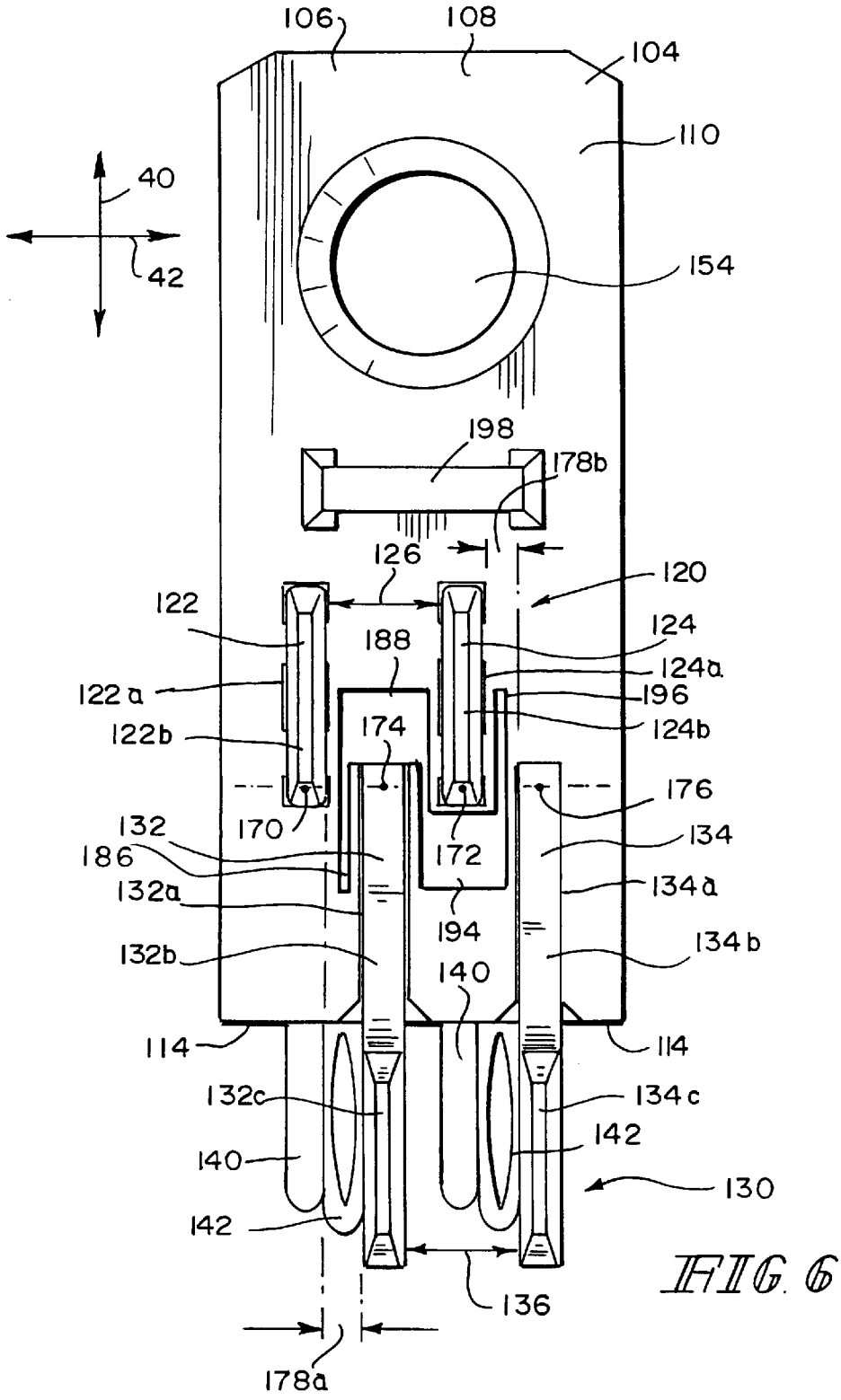
FIG. 6 is a front view of the daughtercard component.
Figure 8:
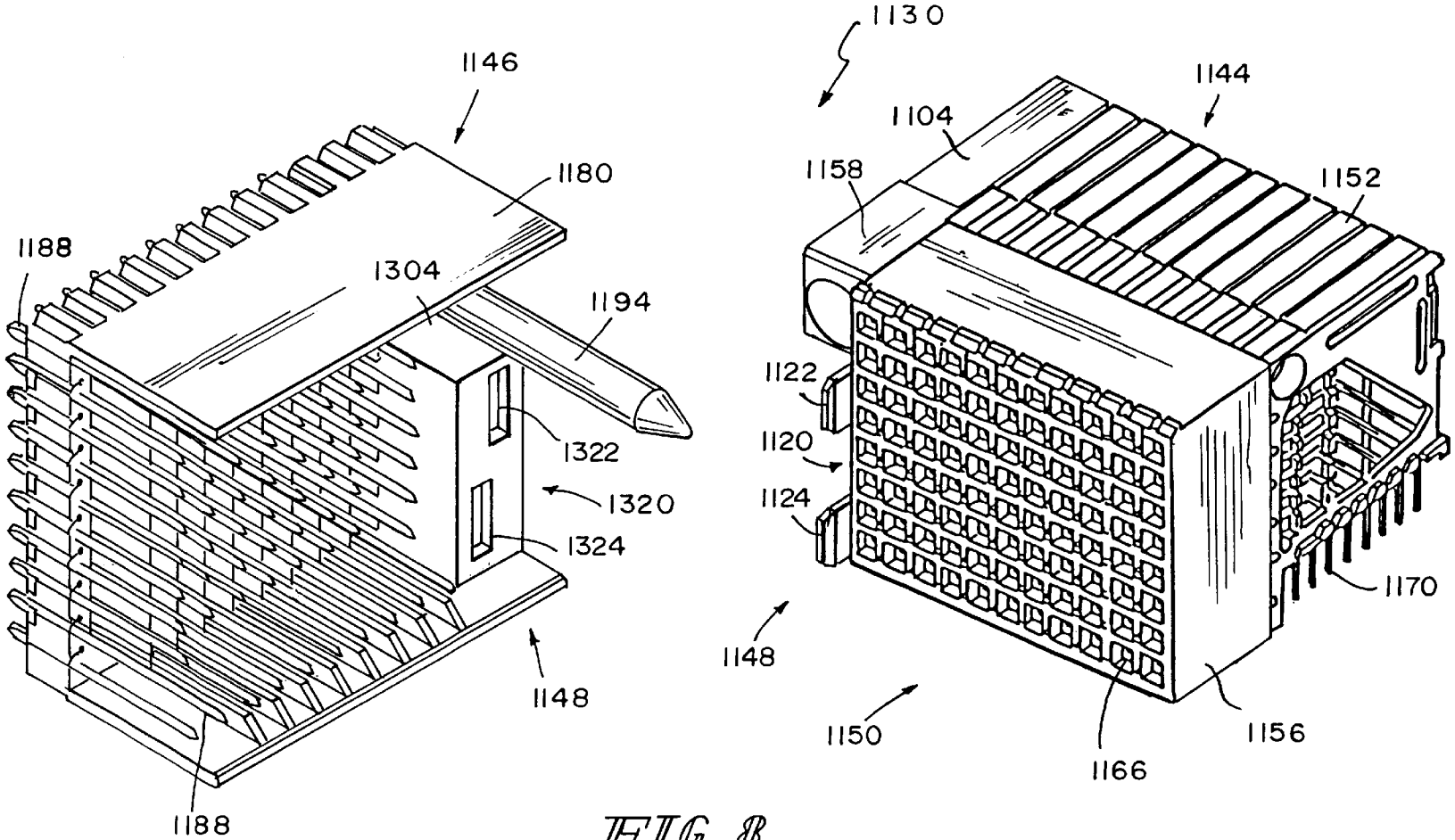
FIG. 8 is a perspective partially exploded view of another embodiment of a two-part right-angle connector in accordance with the present invention, showing a socket connector and a header connector.
Figure 9:
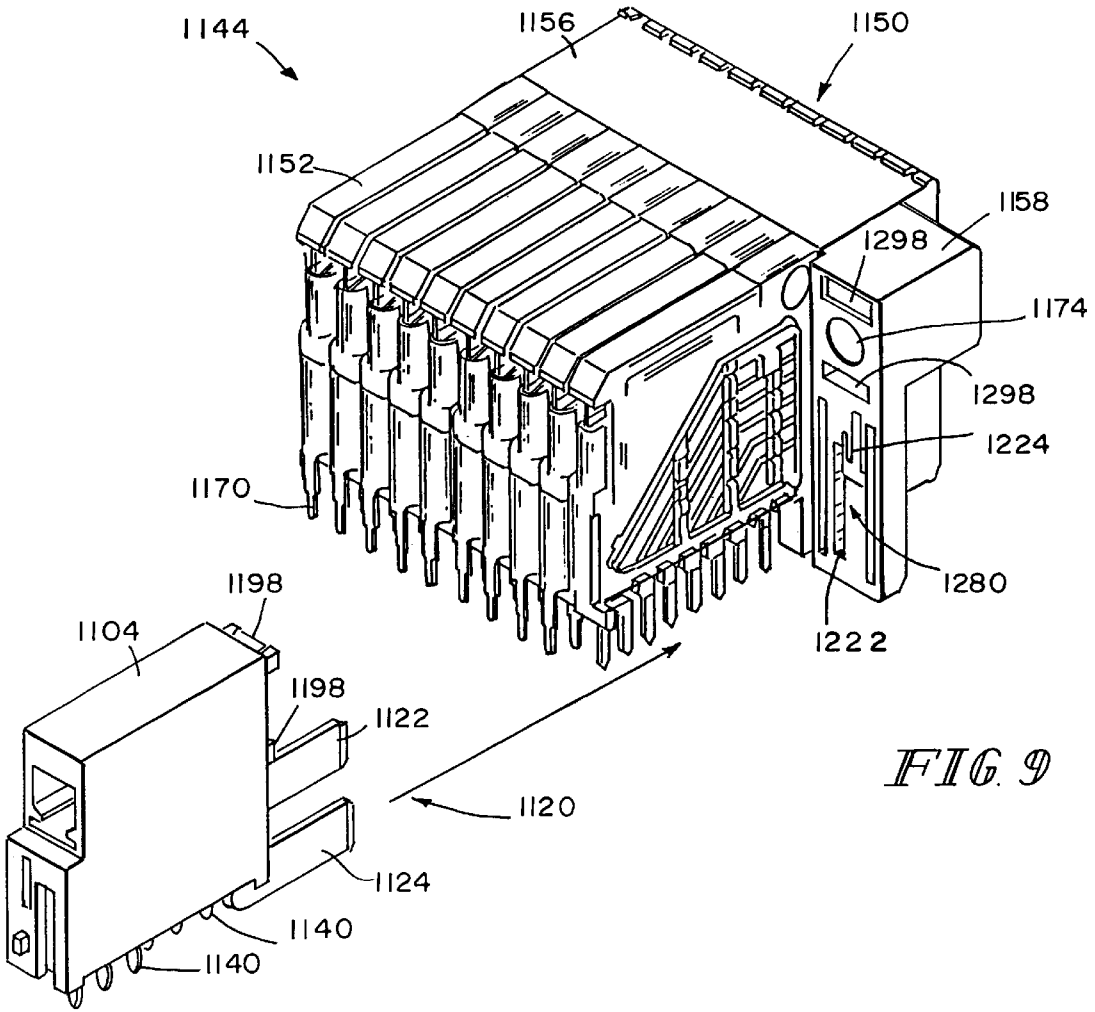
FIG. 9 is a perspective partially exploded view of the socket connector, showing a front cap, a plurality of connector modules, a plurality of pin tails and a daughtercard component.
Figure 11:
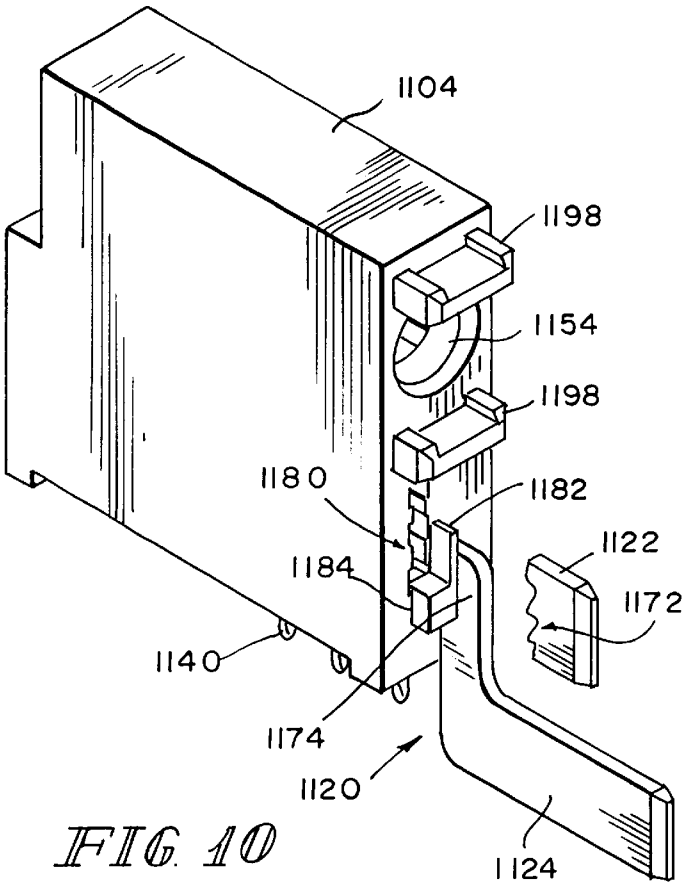
FIG. 11 is an enlarged partial perspective view of a flange portion of the front cap, showing two blade-receiving slots, a complementary creepage maze-receiving cavity, a guide pin-receiving opening and two alignment tab-receiving cavities.
Figure 10:
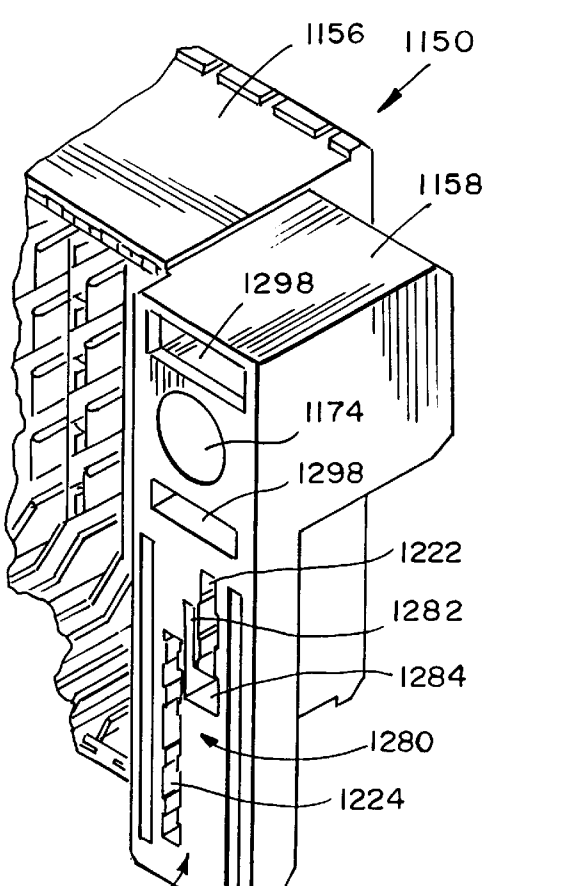
FIG. 10 is an enlarged partial perspective view of the daughtercard component, showing two power blades, a plurality of power connection pins, a creepage maze, two alignment tabs and a guide pin-receiving opening.
Figure 12:
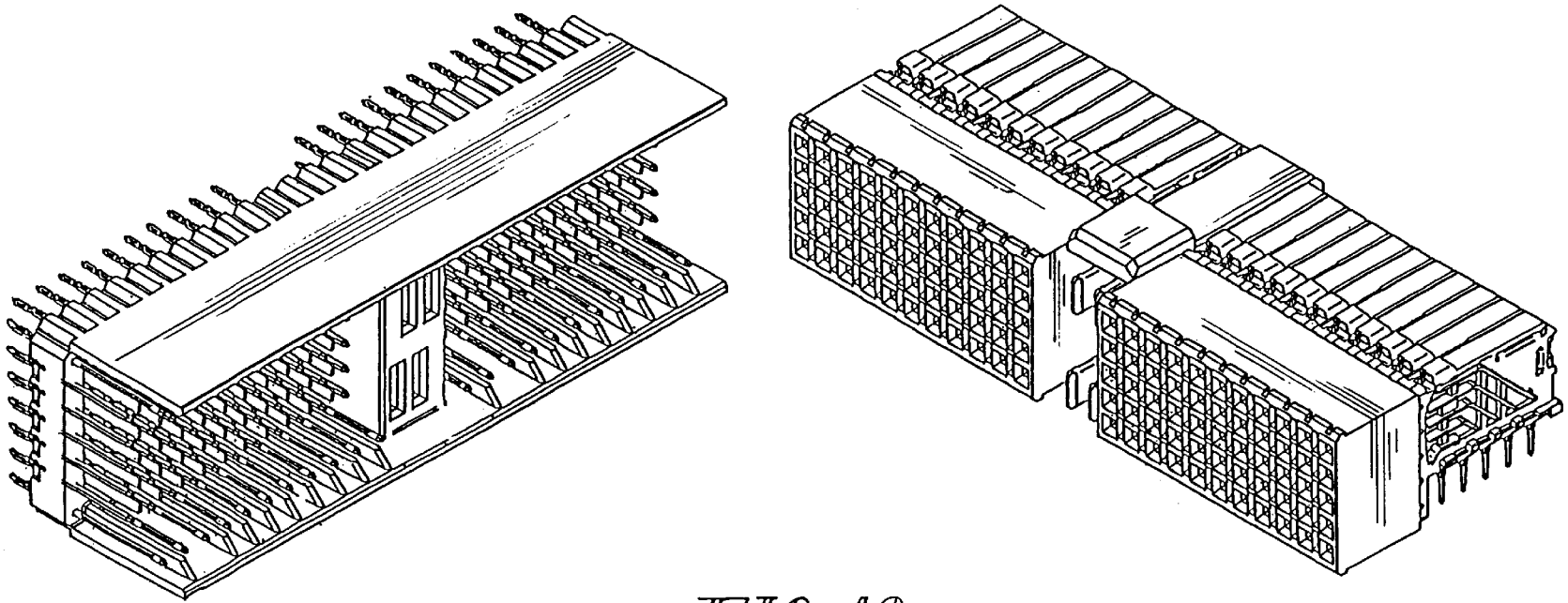
FIG. 12 is a perspective partly-exploded view of a 5-row two-part right-angle A-style connector defined by the IEC 61076-4-101 standard, showing a socket connector and a header connector, and the socket and header connectors each having a portion allocated by the IEC 61076-4-101 standard to a code keying feature.

As previously indicated, the power connector portion 48 transfers power from the motherboard 300 to the daughtercard 100. The daughtercard component 104 is configured to be coupled to the daughtercard 100 and the motherboard component 304 configured to be coupled to the motherboard 300. Referring to FIGS. 4–6, the daughtercard component 104 includes a box-shaped housing 106 formed of electrically insulating material. The housing 106 includes a body 108 having a forwardly-facing flange-engaging face 110, a rearwardly-facing face 112 and a downwardly-facing card-engaging face 114 which is perpendicular to the forwardly-facing flange-engaging face 110.

Referring to FIGS. 5 and 6, a first pair of power blades 120 and a second pair of power blades 130 extend perpendicularly from the forwardly-facing flange-engaging face 110 of the housing 106. The first pair of power blades 120 includes a first blade 122 and a second blade 124 spaced apart from the first blade 122 by a first distance 126 (1.5 millimeters). Likewise, the second pair of power blades 130 includes a third blade 132 and a fourth blade 134 spaced apart from the third blade 132 by a second distance 136 (also, 1.5 millimeters). Twelve power connection pins 140 and two ground connection pins 142 extend perpendicularly from the card-engaging face 114 of the housing 106. Illustratively, the blades 122, 124, 132, 134 are each about 0.5 millimeters wide. The power blades are sometimes referred to herein as blade contacts.

In the illustrated embodiment, the twelve power connection pins 140 are arranged in two groups—each group of six power connection pins comprises three rows of two power connection pins. The first and second blades 122, 124 are each coupled to three power connection pins 140 from a first group. The third and fourth blades 132, 134 are each coupled to three power connection pins 140 from a second group. The twelve power connection pins 140 are received in twelve through holes (not shown) extending through the daughtercard 100. The power connection holes in the daughtercard 100 are likewise arranged in two groups of three rows of two holes each. The power connection pins 140 connect a power source on the motherboard 300 to the power-consuming components on the daughtercard 100 coupled through circuitry terminating at the power connection holes in the daughtercard 100.

Two ground connection pins 142 are arranged in one row for reception in two through holes (not shown) extending through the daughtercard 100. The housing 106 is formed to include a guide pin-receiving circular opening 154 that extends from the forwardly-facing flange-engaging wall 110 through the body 108 to the rearwardly-facing wall 112. The circular opening 154 is separated from blade-receiving cavities in the housing 106 by an insulating wall. When the daughtercard component 104 is inserted into the flange portion 58 of the front cap 50, the forwardly-facing flange-engaging wall 110 of the housing 106 is configured to mate with the rearwardly-facing wall 78 of the flange 58, and the circular opening 154 in the daughtercard component 104 is configured to align with the circular opening 74 in the front cap 50.

As shown in FIG. 4, the daughtercard component 104 includes a guide pin contact 156 that has a first end 158 coupled to the two ground connection pins 142, a middle portion 160 extending along the rearwardly-facing wall 112 of the housing 106 and a second end 162 extending into the guide pin-receiving circular opening 154. The second end 162 of the guide pin contact 156 is configured to engage the guide pin 94 coupled to the ground circuitry on the motherboard 300 when the connectors 44, 46 are mated. Thus, the ground circuitry on the daughtercard 100 is coupled to the ground circuitry on the motherboard 300 through the ground connection pins 142, the guide pin contact 156 and the guide pin 94.

As shown in FIGS. 5 and 6, the first power blade 122 has a first straight portion 122*a* extending through the box-shaped housing 106 and a second straight portion 122*b* extending outwardly from the box-shaped housing 106. The second power blade 124 has a first straight portion 124*a* extending through the box-shaped housing 106 and a second straight portion 124*b* extending outwardly from the box-shaped housing 106. The third power blade 132 has a first straight portion 132*a* extending through the box-shaped housing 106, an intermediate offset portion 132*b* and a second straight portion 132*c* extending outwardly from the box-shaped housing 106. The fourth power blade 134 has a first straight portion 134*a* extending through the box-shaped housing 106, an intermediate offset portion 134*b* and a second straight portion 134*c* extending outwardly from the box-shaped housing 106. The first and second straight portions 132*a*, 132*c* of the third power blade 132 and the first and second straight portions 134*a*, 134*c* of the fourth power blade 134 are offset with respect to each other in the vertical direction 40.

Additionally, as shown more clearly in FIG. 6, the first and second pairs of power blades 120, 130 are offset with respect to each other in the transverse direction 42 so that the third power blade 132 is positioned midway between the first and second power blades 122, 124, and the second power blade 124 is positioned midway between the third and fourth power blades 132, 134. Because of the close spacing of the first and second pairs of power blades 120, 130, the shortest distance 178*a* through the air (0.5 millimeters) between a point 174 on the third power blade 132 and adjacent points 170, 172 on the first and second power blades 122, 124, while greater than the required minimum clearance (0.4 millimeters), is less than the required minimum creepage distance (1.2 millimeters) specified for the insulative material used for the box-shaped housing 106 and for the degree of pollution of the insulative material. Likewise, the shortest distance 178*b* through the air (0.5 millimeters) between the point 172 on the second power blade 124 and adjacent points 174, 176 on the third and fourth power blades 132, 134, while greater than the required minimum clearance (0.4 millimeters), is less than the required minimum creepage distance (1.2 millimeters). The shortest distance 178 through the air between the adjacent portions of the contacts 122, 124, 132, 134 (0.5 millimeters) is sometimes referred to herein as the given distances.

According to this invention, as shown in FIGS. 5 and 6, the forwardly-facing wall 110 of the box-shaped housing 106 is configured to provide a creepage maze 180 around the adjacent points (i.e., a first group of points 170, 174, 172 and a second group of points 174, 172, 176), so that the shortest distance along the insulating material between the adjacent points on the blades 122, 124, 132, 134 is greater than the required minimum creepage distance (1.2 millimeters). The creepage maze 180 includes a first creepage portion 182 that surrounds the point 174 on the third power blade 132, and a second creepage portion 184 that surrounds the point 172 on the second power blade 124. The first and second creepage portions 182, 184 are mirror images of each other as shown. The first creepage portion 182 comprises a wall-like first raised portion 186 extending in the vertical direction 40 between the points 170 and 174, a box-shaped second raised portion 188 extending in the transverse direction 42 between the points 170 and 172 and a wall-like third raised portion 190 extending in the vertical direction 40 between the points 174 and 172. The second creepage portion 184 comprises a wall-like first raised portion 192 extending in the vertical direction 40 between the points 174 and 172, a box-shaped second raised portion 194 extending in the transverse direction 42 between the points 174 and 176 and a wall-like third raised portion 196 extending in the vertical direction 40 between the points 172 and 176.

As a result, the shortest distance along the insulation (2.0 millimeters) between the point 174 on the third power blade 132 and the adjacent points 170, 172 on the first and second power blades 122, 124 is greater than the required minimum creepage distance (1.2 millimeters). Likewise, the shortest distance along the insulation (2.0 millimeters) between the point 172 on the second power blade 124 and the adjacent points 174, 176 on the third and fourth power blades 132, 134 is greater than the required minimum creepage distance (1.2 millimeters). It will be understood that the creepage maze 180 may very well comprise of a plurality of depressed portions, instead of a plurality of raised portions. Also, it will be understood that the phrase "creepage maze" as used throughout the specification and claims simply means a surface irregularity or a geometric shape that increases the creepage distance along the insulative body between two closely-spaced conductive parts, thereby allowing the two conductive parts to be spaced as close as the required minimum clearance would permit. Thus, the creepage maze may be a raised portion, a depressed portion or a combination of the two. Also, the creepage maze may have a rectangular configuration or an arcuate configuration or a combination of the two. Additionally, it will be understood that the application of this invention is not limited to power connectors. This invention is also applicable to any insulative body having two conductors at different voltages, and are closely spaced.

Referring to FIG. 7, the flange portion 58 of the front cap 50 includes a first pair of blade-receiving through slots 220 and a second pair of blade-receiving through slots 230 configured to receive the first pair of power blades 120 and the second pair of power blades 130 respectively when the daughtercard component 104 is inserted into the flange portion 58. The first pair of blade-receiving slots 220 includes blade-receiving slots 222, 224 for receiving blades 122, 124 respectively. The second pair of blade-receiving slots 230 includes blade-receiving slots 232, 234 for receiving blades 132, 134 respectively. The daughtercard component-engaging wall 78 of the flange portion 58 is formed to include a creepage maze-receiving cavity 280 that is complementary to the creepage maze 180 in the flange portion-engaging wall 110 of the daughtercard component 104. When the daughtercard component 104 is inserted into the flange portion 58, the first and second pairs of power blades 120, 130 are configured to pass through the first and second pairs of blade-receiving slots 220, 230 in the flange portion 58, the creepage maze 180 is configured to be received in the complementary creepage maze-receiving cavity 280 in the flange portion 58, and the guide pin-receiving opening 154 is configured to be aligned with the guide pin-receiving opening 74 in the flange portion 58. It will be understood that the complementary creepage maze-receiving cavity 280 may be a raised portion, a depressed portion or a combination of the two. The only requirement is that the creepage maze-receiving cavity 280 and the creepage maze 180 are complementary with respect to each other. The complementary creepage maze-receiving cavity is sometimes referred to herein as a complementary creepage maze.

As shown in FIG. 7, the complementary creepage maze-receiving cavity 280 in the flange portion 58 includes a first complementary creepage maze-receiving cavity portion 282 and a second complementary creepage maze-receiving cavity portion 284. The first complementary creepage maze-receiving cavity portion 282 includes a trench-like first depressed portion 286 configured to receive the wall-like first raised portion 186, a box-shaped second depressed portion 288 configured to receive the box-shaped second raised portion 188 and a trench-like third depressed portion 290 configured to receive the wall-like third raised portion 190. The second complementary creepage maze-receiving cavity portion 284 includes a trench-like first depressed portion 292 configured to receive the wall-like first raised portion 192, a box-shaped second depressed portion 294 configured to receive the box-shaped second raised portion 194 and a trench-like third depressed portion 296 configured to receive the wall-like third raised portion 196. The daughtercard component-engaging wall 78 of the flange portion 58 includes a tab-receiving cavity 298 configured to receive an interlocking tab 198 formed in the flange portion-engaging wall 110 of the daughtercard component 104 when the daughtercard component 104 is inserted into the flange portion 58.

In the illustrated embodiment, the motherboard component 304 is integrally-formed with the header body 80. It will be understood however that the motherboard component 304 may very well be separate from the header body 80. As shown in FIG. 3, the motherboard component 304 includes a box-shaped housing 306 formed of electrically insulative material. The housing 306 includes a forwardly-facing board-engaging wall (obscured view) configured to engage the motherboard 300 and a rearwardly-facing flange-engaging wall 312 configured to engage a forwardly-facing header-engaging wall (obscured view) of the flange portion 58. The housing 306 includes a first pair of blade receptacles 320 and a second pair of blade receptacles 330 configured to receive the first pair of power blades 120 and the second pair of power blades 130 when the socket connector 44 is mated with the header connector 46. The first pair of blade receptacles 320 includes blade receptacles 322, 324 for receiving blades 122, 124. The second pair of blade receptacles 330 includes blade receptacles 332, 334 for receiving blades 132, 134. The blade receptacles 322, 324 are received in receptacle-receiving slots in the housing 306 that extend from the forwardly-facing board-engaging wall thereof (obscured view) through the body of the housing 306 to the rearwardly-facing flange-engaging wall 312 of the housing 306. The blade receptacles 332, 334 are received in receptacle-receiving slots in the housing 306 that extend from the forwardly-facing board-engaging wall thereof (obscured view) through the body of the housing 306 to the rearwardly-facing flange-engaging wall 312 of the housing 306. The four receptacle-receiving slots are electrically insulated from each other by insulating material. The blade receptacles are sometimes referred to herein as receptacle contacts.

In operation, when the daughtercard component 104 is inserted into the flange portion 58 of the front cap 50, the power blades 122, 124, 132, 134 extend through the blade-receiving slots 222, 224, 232, 234 in the flange portion 58, the creepage maze 180 is received in the complementary creepage maze cavity 280, the interlocking tab 198 is received in the tab-receiving cavity 298, and the guide pin-receiving opening 154 is aligned with the guide pin-receiving opening 74. When the socket connector 44 comprising the front cap 50, connector modules 52 and the daughtercard component 104 is inserted into the header connector 46, the guide pin 94 extends through the guide pin-receiving openings 74 and 154 and engages the guide pin contact 156, the guide finger 76 is inserted into the guide finger-receiving slot 96, the signal pins 88 are inserted into the receptacle contacts 68 through the pin-insertion windows 66, and the power blades 122, 124, 132, 134 are received in the blade receptacles 322, 324, 332, 334. Thus, the signal pins 88 of the header connector 46 are coupled to the corresponding pin tails 70 of the socket connector 44, the blade receptacles 322, 324, 332, 334 of the header connector 46 are coupled to the corresponding power connection pins 140 of the socket connector 44, and the guide pin 94 of the header connector 46 is coupled to the ground connection pins 142 of the socket connector 44. As a result, the power source on the motherboard 300 is coupled to the power-consuming components on the daughtercard 100 through the blade receptacles 322, 324, 332, 334, power blades 122, 124, 132, 134 and the power connection pins 140. The ground circuitry on the motherboard 300 is coupled to the ground circuitry on the daughtercard 100 through the guide pin 94, guide pin contact 156 and the ground connection pins 142.

The connector 30 is configured as an inverse right angle connector providing power to the daughtercard 100. The connector 30 is considered an inverse connector because the female power receptacles 322, 324, 332, 334 in the motherboard component 304 are coupled to the power supply. Thus the "hot" electrical contacts (i.e., the power receptacles 322, 324, 332, 334) are on the motherboard 300. Inversely, the "cold" electrical contacts (i.e., the power blades 122, 124, 132, 134) are on the daughtercard 100, thereby protecting the user during hot swapping. While the invention is illustratively described with reference to a right angle connector, it is to be understood that the scope of the invention should not be limited to any specific configuration of the connector.

FIGS. 8–11 illustrate another embodiment of a two-part right-angle connector having a creepage maze. Although the two-part connector illustrated in FIGS. 8–11 includes a portion defined by the IEC 61076-4-101 specification, it may very well be a custom design. As previously mentioned, IEC 61076-4-101 shall mean the IEC 61076-4-101:2001. The illustrated connector 1130 includes a socket connector 1144 and a header connector 1146. The socket connector 1144 includes a front cap 1150, a plurality of connector modules 1152, a plurality of pin tails 1170 and a daughtercard component 1104. The header connector 1146 includes a header body 1180, a plurality of signal pins 1188 and a motherboard component 1304. The daughtercard component 1104 and the motherboard component 1304 comprise the power connector portion 1148 of the connector 1130.

The daughtercard component 1104 includes a pair of power blades 1122, 1124, a plurality of power connection pins 1140, a pair of daughtercard component-alignment tabs 1198 and a guide pin-receiving opening 1154. The front cap 1150 includes a flange portion 1158. The flange portion 1158 includes a pair of blade-receiving slots 1222, 1224, a guide pin-receiving opening 1174 and a pair of tab-receiving cavities 1298. The motherboard component 1304 includes a pair of receptacle contacts 1322, 1324 and a guide pin 1194.

Because of the close spacing of the power blades 1122, 1124, the shortest distance through the air (0.5 millimeters) between adjacent points 1172, 1174 on the power blades 1122, 1124, while greater than the required minimum clearance (0.4 millimeters), is less than the required minimum creepage distance (1.2 millimeters) specified for the insulative material used for the daughtercard component 1104 and for the degree of pollution of the insulative material. According to this invention, the daughtercard component 1104 is configured to provide a creepage maze 1180 around the adjacent points 1172, 1174 of the power blades 1122, 1124, so that the shortest distance along the insulating material between the adjacent points 1172, 1174 is greater than the required minimum creepage distance (1.2 millimeters). The creepage maze 1180 includes a wall-like first raised portion 1182 and a box-shaped second raised portion 1184. The flange portion 1158 of the front cap 1150 includes a complementary creepage maze-receiving cavity 1280 comprising a trench-like first depressed portion 1282 and a box-shaped second depressed portion 1284. The creepage maze 1180 and the creepage maze-receiving cavity 1280 are complementary with respect to each other.

It will be understood that the creepage maze 1180 may very well comprise of a plurality of depressed portions, instead of a plurality of raised portions. Also, it will be understood that the phrase "creepage maze" as used throughout the specification and claims simply means a surface irregularity or a geometric shape that increases the creepage distance along the insulative body between two closely-spaced conductive parts, thereby allowing the two conductive parts to be spaced as close as the required minimum clearance would permit. Thus, the creepage maze may be a raised portion, a depressed portion or a combination of the two. Also, the creepage may have a rectangular configuration or an arcuate configuration or a combination of the two.

In operation, when the daughtercard component 1104 is inserted into the flange portion 1158 of the front cap 1150, the power blades 1122, 1124 extend through the blade-receiving slots 1222, 1224 in the flange portion 1158, the creepage maze 1180 is received in the complementary creepage maze cavity 1280, the interlocking tabs 1198 are received in the tab-receiving cavities 1298, and the guide pin-receiving opening 1154 is aligned with the guide pin-receiving opening 1174. When the socket connector 1144 comprising the front cap 1150, connector modules 1152 and the daughtercard component 1104 is inserted into the header connector 1146, the guide pin 1194 extends through the guide pin-receiving openings 1174 and 1154 and engages a guide pin contact (obscured view), the signal pins 1188 are inserted into the receptacle contacts (obscured view) through the pin-insertion windows 1166, and the power blades 1122, 1124 are received in the blade receptacles 1322, 1324. Thus, the signal pins 1188 of the header connector 1146 are coupled to the corresponding pin tails 1170 of the socket connector 1144, the blade receptacles 1322, 1324 of the header connector 1146 are coupled to the corresponding power connection pins 1140 of the socket connector 1144, and the guide pin 1194 of the header connector 1146 is coupled to the ground connection pins (obscured view) of the socket connector 1144. As a result, the power source on the motherboard is coupled to the power-consuming components on the daughtercard through the blade receptacles 1322, 1324, the power blades 1122, 1124 and the power connection pins 1140. The ground circuitry on the motherboard is coupled to the ground circuitry on the daughtercard through the guide pin 1194, the guide pin contact and the ground connection pins.

Although the present invention has been described in detail with reference to certain preferred embodiments, variations and modifications exist within the scope and spirit of the present invention as described above.

What is claimed is:

1. An electrical connector including a first contact, a second contact spaced apart from the first contact by a given distance, and monolithic insulative material extending between the first and second contacts, the given distance between the first and second contacts being greater than the minimum clearance distance, but smaller than the minimum creep age distance specified by the IEC 60950-1:2001 standard for the material group of the insulative material and for the degree of pollution of the insulative material, the monolithic insulative material extending between the first and second contacts including a creepage maze positioned between the first and second contacts so that the actual creepage distance along the monolithic insulative material between the first and second contacts is greater than the minimum creep age distance.

2. An electrical connector including a first insulative body having a first contact and a second contact spaced apart from the first contact by a given distance, the first insulative body including a first monolithic insulative surface extending between the first and second contacts, the given distance between the first and second contacts being greater than the minimum clearance distance, but smaller than the minimum creepage distance specified by the IEC 60950-1:2001 standard for the material group of the insulative body and for the degree of pollution of the insulative body, the first monolithic insulative surface extending between the first and second contacts including a creep age maze positioned between the first and second contacts so that the actual creepage distance along the first monolithic insulative surface between the first and second contacts is greater than the minimum creepage distance.

3. The connector of claim 2, including a second insulative body configured to mate with the first insulative body, wherein the second insulative body has a first contact-receiving opening and a second contact-receiving opening spaced apart from the first contact-receiving opening by the given distance, wherein the second insulative body includes a second insulative surface extending between the first and second contact-receiving openings, wherein the first and second contact-receiving openings receive the first and second contacts such that the distal ends of the first and second contacts extend beyond the second insulative body and the second insulative surface abuts the first insulative surface when the insulative bodies are mated, and wherein the second insulative surface includes a complementary creep age maze positioned between the first and second contact-receiving openings, the complementary creepage maze being configured to mate with the creepage maze when the insulative bodies are mated.

4. An electrical connector comprising:

a first insulative body having a first contact and a second contact spaced apart from the first contact by a given distance, the first insulative body including a first monolithic insulative surface extending between the first and second contacts, the given distance between the first and second contacts being greater than the minimum clearance distance, but smaller than the minimum creepage distance specified by the IEC 60950-1:2001 standard for the material group of the insulative body and for the degree of pollution of the insulative body, and a second insulative body configured to mate with the first insulative body, the second insulative body having a first contact-receiving opening and a second contact-receiving opening spaced apart from the first contact-receiving opening by the given distance, the second insulative body including a second monolithic insulative surface extending between the first and second contact-receiving openings, the first and second contact-receiving openings receiving the first and second contacts and the second insulative surface abutting the first insulative surface when the insulative bodies are mated, the first monolithic ins insulative surface extending between the first and second contacts including a creepage maze positioned between the first and second contacts so that the actual creepage distance along the first monolithic insulative surface between the first and second contacts is greater than the minimum creep age distance, the second monolithic insulative surface including a complementary creepage maze positioned between the first and second contact-receiving openings, the complementary creepage maze of the second insulative body being configured to mate with the creepage maze of the first insulative body when the two insulative bodies are mated.

5. A power connector comprising:

a first insulative body having a first power blade and a second power blade spaced apart from the first power blade by a given distance, the first insulative body including a first monolithic insulative surface extending between the first and second power blades, the given distance between the first and second contacts being greater than the minimum clearance distance, but smaller than the minimum creepage distance specified by the IEC 60950-1:2001 standard for the material group of the insulative body and for the degree of pollution of the insulative body, and a second insulative body configured to mate with the first insulative body, the second insulative body having a first blade-receiving opening and a second blade-receiving opening spared apart from the first blade-receiving opening by the given distance, the second insulative body including a second monolithic insulative surface extending between the first and second blade-receiving openings, the first and second blade-receiving openings receiving the first and second power blades and the second insulative surface abutting the first insulative surface when the insulative bodies are mated, the first monolithic insulative surface extending between the first and second power blades including a creepage maze positioned between the first and second power blades so that the actual creepage distance along the first monolithic insulative surface between the first and second power blades is greater than the minimum creepage distance, the second monolithic insulative surface including a complementary creepage maze positioned between the first and second blade-receiving openings, the complementary creepage maze of the second insulative body being configured to mate with the creepage maze of the first insulative body when the two insulative bodies are mated.

6. The connector of claim 5, wherein the given distance between the fist and second power blades is 0.5 millimeters, wherein the minimum clearance distance between the first and second power blades is 0.4 millimeters, and the minimum creepage distance specified for the material group of the first insulative body and for the degree of pollution of the first insulative body is 1.2 millimeters.

7. The connector of claim 5, wherein the shortest path along the first insulative surface between the first and second power blades is sufficient to prevent breakdown along the first insulative surface between the first and second power blades.

8. The connector of claim 5, wherein the creepage maze comprises a raised portion separating the first and second power blades, and the complementary creepage maze comprises a depressed portion separating the first and second blade-receiving openings and configured to receive the raised portion when the insulative bodies are mated.

9. The connector of claim 5, wherein the creepage maze comprises a depressed portion separating the first and second power blades, and the complementary creepage maze comprises a raised portion separating the first and second blade-receiving openings and configured to be received in the depressed portion when the insulative bodies are mated.

10. The connector of claim 5, wherein the first insulative body includes a first alignment portion and the second insulative body includes a second alignment portion configured to mate with the first alignment portion when the insulative bodies are mated.

11. The connector of claim 10, wherein one of the alignment portions is a tab and the other of the alignment portions is a tab-receiving cavity sized to receive the tab when the insulative bodies are mated.

12. The connector of claim 5, wherein the distal ends of the first and second power blades extend beyond the second insulative body when the first and second insulative bodies are mated.

13. A power connector comprising:

a first insulative body having a first power blade and a second power blade spaced apart from the first power blade by a liven distance, the first insulative body including a first monolithic insulative surface extending between the first amid second power blades, the given distance between the first and second contacts being greater than the minimum clearance distance, but smaller than the minimum creepage distance specified by the IEC 60950 standard for the material group of the insulative body and for the degree of pollution of the insulative body, a second insulative body configured to mate with the first insulative body, the second insulative body having a first blade-receiving opening and a second blade-receiving opening spaced apart from the first blade-receiving opening by the given distance, the second insulative body including a second monolithic insulative surface extending between the first and second blade-receiving openings, the first and second blade-receiving openings receiving the first and second power blades such that the distal ends of the first and second power blades extend beyond the second insulative body and the second insulative surface abutting the first insulative surface when the insulative bodies are mated, and a third insulative body configured to mate with the second insulative body, the third insulative body including a first receptacle contact and a second receptacle contact spaced apart from the first receptacle contact by the given distance, the first monolithic insulative surface extending between the first and second power blades including a creepage maze positioned between the first and second power blades so that the actual creepage distance along the first monolithic insulative surface between the first and second power blades is greater than the minimum creepage distance, the second monolithic insulative surface including a complementary creepage maze positioned between the first and second blade-receiving openings, the complementary creepage maze of the second insulative body being configured to mate with the creepage maze of the first insulative body when the first and second insulative bodies are mated, the first and second receptacle contacts being configured to receive the distal ends of the first and second power blades extending beyond the second insulative body when the third insulative body is mated with the first and second insulative bodies.

14. The connector of claim 13, wherein the first insulative body includes a card-engaging surface having card contacts for coupling to the daughtercard, and wherein the first and second power blades are coupled to the card contacts.

15. The connector of claim 14, wherein the third insulative body includes a board-engaging surface having board contacts for coupling to the motherboard, and wherein the first and second receptacle contacts are coupled to the board contacts.

16. The connector of claim 13, for use with a two-part connector defined by the IEC 61076-4-101:2001 standard and comprising a header connector and a socket connector, the header and socket connectors each having a portion allocated by the IEC 61076-4-101:2001 standard to a code keying feature, wherein the first and second insulative bodies are located at the portion of the socket connector allocated to the code keying feature, wherein the third insulative body is located at the portion of the header connector allocated to the code keying feature, and wherein the first, second and third insulative bodies are mated when the header and socket connectors are mated.

17. The connector of claim 16, wherein the second insulative body is integrally formed with the socket connector in the portion thereof allocated to the code keying feature, and wherein the first insulative body is separate from the socket connector and is configured to mate with the second insulative body.

18. The connector of claim 16, wherein the third insulative body is integrally formed with the header connector in the portion thereof allocated to the code keying feature.

19. A two-p art connector defined by the IEC 61076-4-101:2001 standard and comprising a header connector and a socket connector, the header and socket connectors each having a portion allocated by the IEC 61076-4-101:2001 standard to a code keying feature, a first one of the header and socket connectors having power blades located at the portion thereof allocated to the code keying feature, a second one of the header and socket connectors having blade receptacles located at the portion thereof allocated to the code keying feature such that the power blades are received in the blade receptacles when the header and socket connectors are mated to transfer power from one of the header and socket connectors to the other of header and socket connectors.

20. The connector of claim 14, wherein the connector is an A-style connector defined by the IEC 61076-4-101:2001 standard.

21. The connector of claim 14, wherein the connector is a D-style connector defined by the IEC 61076-4-101:2001 standard.

22. The connector of claim 14, wherein the power blades are incorporated in the socket connector and the blade receptacles are incorporated in the header connector.

23. The connector of claim 14, wherein the blade receptacles are incorporated in the socket connector and the power blades are incorporated in the header connector.

24. The connector of claim 14, wherein the portion of the socket connector allocated to the code keying feature includes a first power blade, a second power blade spaced apart from the first power blade by a given distance, and insulative material extending between the first and second power blades, wherein the insulative material includes a creepage maze positioned between the first and second power blades.

25. The connector of claim 14, further including first, second and third insulative bodies, wherein the first insulative body has a first power blade and a second power blade spaced apart from the first power blade by a given distance, wherein the first insulative body includes a first insulative surface extending between the first and second power blades, wherein the second insulative body is configured to mate with the first insulative body, wherein the second insulative body has a first blade-receiving opening and a second blade-receiving opening spaced apart from the first blade-receiving opening by the given distance, wherein the second insulative body includes a second insulative surface extending between the first and second blade-receiving openings, wherein the first and second blade-receiving openings receive the first and second power blades such that the distal ends of the first and second power blades extend beyond the second insulative body and the second insulative surface abuts the first insulative surface when the first and second insulative bodies are mated, wherein the third insulative body is configured to mate with the second insulative body, wherein the third insulative body includes a first receptacle contact and a second receptacle contact spaced apart from the first receptacle contact by the given distance, and wherein the first and second receptacle contacts are configured to receive the distal ends of the first and second power blades extending beyond the second insulative body when the third insulative body is mated with the first and second insulative bodies, wherein the second insulative body is integrally formed with the socket connector in the portion thereof allocated to the code keying feature, wherein the first insulative body is separate from the socket connector and is configured to mate with the second insulative body, wherein, the third insulative body is integrally formed with the header connector in the portion thereof allocated to the code keying feature, wherein the first insulative surface includes a creep age maze positioned between the first and second power blades, wherein the second insulative surface includes a complementary creepage maze positioned between the first and second blade-receiving openings, and wherein the complementary creepage maze is configured to mate with the first-mentioned creep age maze when the first and second insulative bodies are mated.

26. A two-part connector defined by the IEC 61076-4-101:2001 standard and comprising a header connector and a socket connector, the header and socket connectors each having a portion reserved for multi-purpose center by the IEC 61076-4-101:2001 standard, a first one of the header and socket connectors having power blades located at the portion thereof reserved for multi-purpose center, a second one of the header and socket connectors having blade receptacles located at the portion thereof reserved for multi-purpose center such that the power blades are received in the blade receptacles when the header and socket connectors are mated to transfer power from one of the header and socket connectors to the other of header and socket connectors.

27. The connector of claim 26, wherein the connector is an A-style connector defined by the IEC 61076-4-101:2001 standard.

28. The connector of claim 26, wherein the connector is a D-style connector defined by the LEG 61076-4-101:2001 standard.

29. The connector of claim 26, wherein the power blades are incorporated in the socket connector and the blade receptacles are incorporated in the header connector.

30. The connector of claim 26, wherein blade receptacles the are incorporated in the socket connector and the power blades are incorporated in the header connector.

31. The two-part connector of claim 26, and further comprising fist and second alignment features distinct from the power blades and blade receptacles, wherein the first alignment feature is incorporated into a first one of the header and socket connectors located at the portion thereof allocated to the multi-purpose center and the second alignment feature is incorporated into a second one of the header and socket connectors located at the portion thereof allocated to the multi-purpose center.

32. The two-part connector of claim 31, wherein the first and second alignment features align the power blades and blade receptacles prior to mating of the header and socket connectors.

33. The two-part connector of claim 31, wherein the power blades are incorporated into the socket connector, wherein the blade receptacles are incorporated into the header connector, wherein the first alignment feature is an electrically conductive guide pin incorporated in the header connector, wherein the second alignment feature is an opening having an electrically conductive guide pin contact incorporated in the socket connector, wherein the guide pin and the guide pin contact electrically couple prior to electrical coupling of the power blades and blade receptacles during mating of the header and socket connectors.

34. The two-part connector of claim 31, wherein the first alignment feature is electrically conductive.

35. The two-part connector of claim 34, comprising an electrical contact adjacent the second alignment feature adapted to electrically couple to the first alignment feature upon mating of the header and socket connectors.

36. The two-part connector of claim 35, wherein the first alignment feature and the electrical contact electrically couple prior to electrical coupling of the power blades and blade receptacles during mating of the header and socket connectors.

37. A two-part connector comprising a header connector and a socket connector, the header and socket connectors each having a portion defined by the IEC 61076-4-101:2001 standard and further comprising a power blade incorporated into one of the header and socket connectors and a blade receptacle incorporated into the other of the header and socket connectors such that the power blade is received in the blade receptacle when the header and socket connectors are mated to transfer power from one of the header and socket connectors to the other of header and socket connectors.

38. The two-part connector of claim 37, and further comprising an electrical contact in the other of the header and socket connectors, said electrical contact being positioned to be electrically coupled to the power blade upon mating of the header and socket connectors.

39. The two-part connector of claim 38, wherein the power blade is incorporated into the socket connector and the blade receptacle is incorporated into the header connector.

40. The two-part connector of claim 38, and further comprising a second power blade incorporated into one of the header and socket connectors and a second blade receptacle incorporated into the other of the header and socket connectors, said second blade receptacle being adapted to receive the second power blade therein upon mating of the header and socket connectors.

41. The two-part connector of claim 40, wherein the first and second power blades are incorporated into the same one of the header and socket connectors.

42. The two-part connector of claim 41, and further comprising a second electrical contact in the other of the header and socket connectors, said second electrical contact being positioned to be electrically coupled to the second power blade upon mating of the header and socket connectors.

43. The two-part connector of claim 42, and further comprising first and second alignment features distinct from the first and second power blades and the first and second blade receptacles, the first alignment feature being incorporated into one of the header and socket connectors and the second alignment feature incorporated into the other of the header and socket connectors, the first and second alignment features cooperating to induce the first power blade and first blade receptacle to align prior to mating of the header and socket connectors.

44. The two-part connector of claim 43, wherein the first alignment feature is electrically conductive.

45. The two-part connector of claim 44, comprising a third electrical contact adjacent the second alignment feature adapted to be electrically coupled to the first alignment feature upon mating of the header and socket connectors.

46. The two-part connector of claim 45, wherein the first alignment feature and the third electrical contact electrically couple prior to electrical coupling of the first power blade and first electrical contact during mating of the header and socket connectors.

47. The two-part connector of claim 46, wherein the first power blade and the first electrical contact electrically couple prior to electrical coupling of the second power blade and second electrical contact during mating of the header and socket connectors.

48. The two-part connector of claim 47, wherein the first and second power blades are incorporated into the socket connector, wherein the first and second blade receptacles are incorporated into the header connector, wherein the first alignment feature is an electrically conductive guide pin incorporated in the header connector, wherein the second alignment feature is an opening having an electrically conductive guide pin contact incorporated in the socket connector, wherein the guide pin and the third electrical contact electrically couple prior to electrical coupling of the first power blade and first electrical contact, and wherein the first power blade and the first electrical contact electrically couple prior to electrical coupling of the second power blade and second electrical contact during mating of the header and socket connectors.

49. An electrical power connector comprising:

a first insulative body including a first monolithic insulative surface having a first pair of blade contacts and a second pair of blade contacts, a portion of one of the first pair of blade contacts being positioned adjacent to the second pair of blade contacts, a portion of one of the second pair of blade contacts being positioned adjacent to the first pair of blade contacts, and a second insulative body configured to mate with the first insulative body, the second insulative body including a second monolithic insulative surface having a first pair of blade-receiving openings and a second pair of blade-receiving openings, a portion of one of the first pair of blade-receiving openings being positioned adjacent to the second pair of blade-receiving openings, a portion of one of the second pair of blade-receiving openings being positioned adjacent to the first pair of blade-receiving openings, the first pair of blade-receiving openings being configured to receive the first pair of blade contacts, the second pair of blade-receiving openings being configured to receive the second pair of blade contacts, the second insulative surface being configured to abut the first insulative surface, the first monolithic insulative surface including a creepage maze positioned around the adjacent portions of the first and second pairs of blade contacts, the second monolithic insulative surface including a complementary creepage maze positioned around the adjacent portions of the first and second pairs of blade-receiving openings, the complementary creepage maze of the second insulative body being configured to mate with the creepage maze of the first insulative body when the two insulative bodies are mated.

* * * * *

UNITED STATES PATENT AND TRADEMARK OFFICE

CERTIFICATE OF CORRECTION

PATENT NO. : 6,716,045 B2
DATED : April 6, 2004
INVENTOR(S) : Meredith, Kevin R.

It is certified that error appears in the above-identified patent and that said Letters Patent is hereby corrected as shown below:

Column 3,
Line 36, delete “fight-angle” and insert -- right-angle -- therefor.
Lines 63-64, delete “creep age” and insert -- creepage -- therefor.

Column 4,
Line 4, delete “creep age” and insert -- creepage -- therefor.
Line 7, after “Application” insert -- , --.
Line 12, delete “IBC” and insert -- IEC --.

Column 9,
Line 26, delete “integrally-formed” and insert -- integrally fromed -- therefor.

Column 12,
Lines 8, 16, 28 and 47, delete “creep age” and insert -- creepage -- therefor.

Column 13,
Line 8, after “monolithic” delete “ins”.
Line 13, delete “creep age” and insert -- creepage -- therefor.
Line 34, delete “spared”and insert -- spaced -- therefor.
Line 57, delete “fist” and insert -- first -- therefor.

Column 14,
Line 29, delete “liven” and insert -- given -- therefor.
Line 31, delete “amid” and insert -- and -- therefor.

Column 15,
Line 38, delete “two-p art” and insert -- two-part -- therefor.
Lines 52, 55, 58, 61 and 64, delete “claim 14” and insert -- claim 19 -- therefor.

Column 16,
Line 5, delete “claim 14” and insert -- claim 19 -- therefor.
Lines 44 and 50, delete “creep age” and insert -- creepage -- therefor.

UNITED STATES PATENT AND TRADEMARK OFFICE

CERTIFICATE OF CORRECTION

PATENT NO. : 6,716,045 B2
DATED : April 6, 2004
INVENTOR(S) : Meredith, Kevin R.

It is certified that error appears in the above-identified patent and that said Letters Patent is hereby corrected as shown below:

Column 17,
Line 2, delete “LEG” and insert -- IEC -- therefor.
Line 11, delete “fist” and insert -- first -- therefor.

Signed and Sealed this

Seventeenth Day of August, 2004

JON W. DUDAS
*Acting Director of the United States Patent and Trademark Office*